US006194117B1

(12) United States Patent
Smith et al.

(10) Patent No.: US 6,194,117 B1
(45) Date of Patent: Feb. 27, 2001

(54) CARRIER COMPOSITION AND PROCESSES THEREOF

(75) Inventors: Lewis S. Smith, Fairport; Juan M. Tirado; William H. Hollenbaugh, Jr., both of Rochester; Scott M. Silence, Fairport; K. Derek Henderson, Rochester; Susan J. LaFica, Fairport; Amy L. Stamp, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/383,917

(22) Filed: Aug. 26, 1999

(51) Int. Cl.[7] ..... G03G 9/00
(52) U.S. Cl. ..... 430/137
(58) Field of Search ..... 430/137

(56) References Cited

U.S. PATENT DOCUMENTS

| | | | | |
|---|---|---|---|---|
| 2,986,521 | | 5/1961 | Wielicki | 252/62.1 |
| 3,893,935 | | 7/1975 | Jadwin et al. | 252/62.1 |
| 4,298,672 | | 11/1981 | Lu | 430/108 |
| 4,338,390 | | 7/1982 | Lu | 430/106 |
| 4,404,271 | | 9/1983 | Kawagishi et al. | 430/110 |
| 4,411,974 | | 10/1983 | Lu et al. | 430/106 |
| 5,569,572 | | 10/1996 | Laing et al. | 430/137 |
| 5,683,844 | * | 11/1997 | Mammino | 430/106.6 |
| 5,927,510 | * | 7/1999 | Leute et al. | 209/142 |
| 6,051,354 | * | 4/2000 | Veregin et al. | 430/108 |

* cited by examiner

*Primary Examiner*—Mark Chapman
(74) *Attorney, Agent, or Firm*—John L. Haack

(57) ABSTRACT

A process including: blending carrier particles in a fluidized bed jet mill and continuously separating fine particles formed therein from the resulting blended carrier particles.

18 Claims, 1 Drawing Sheet

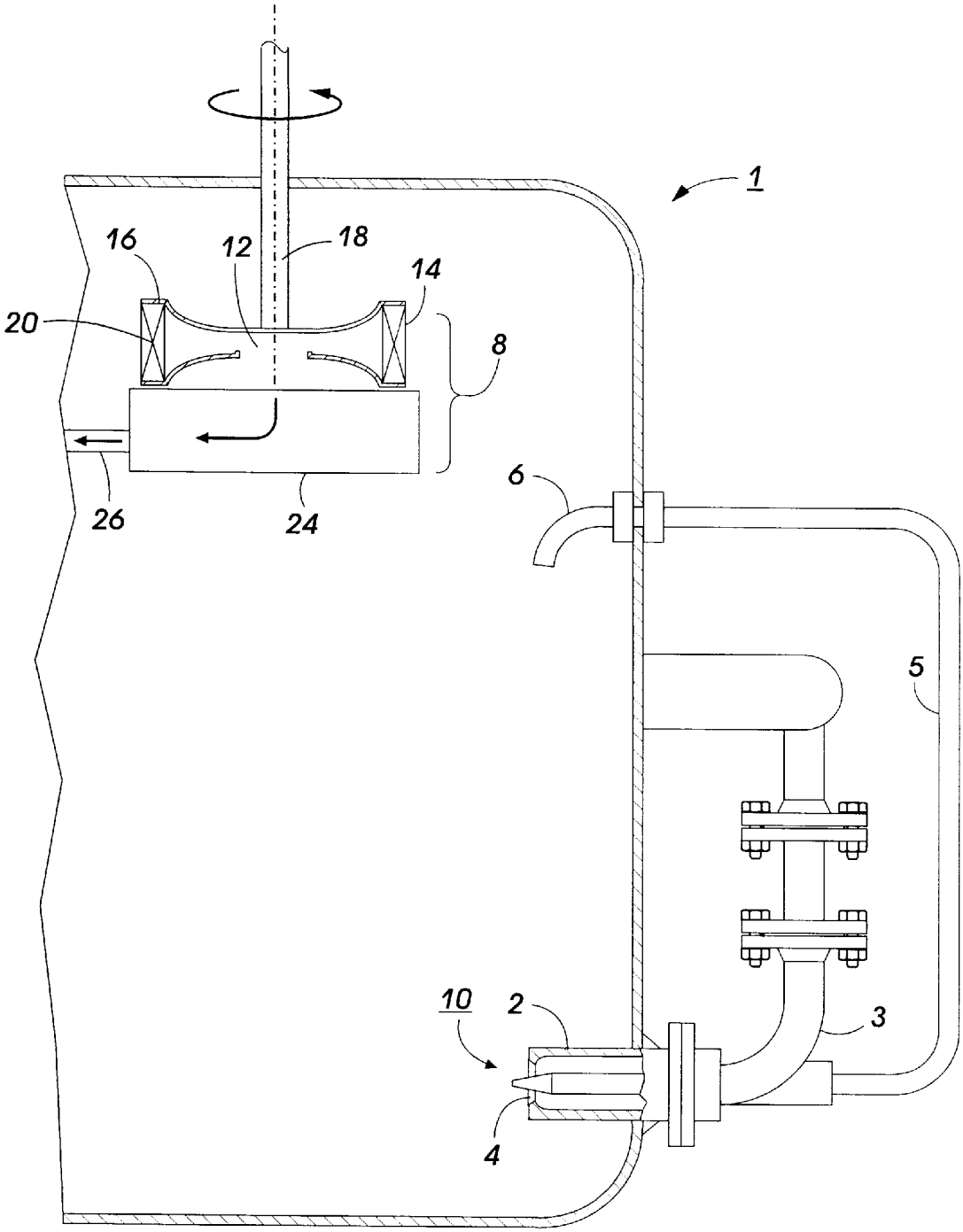
1
16
12
18
14
20
8
26
24
6
5
10
2
3
4

CARRIER COMPOSITION AND PROCESSES THEREOF

REFERENCE TO ISSUED PATENTS

Attention is directed to commonly owned and assigned U.S. Pat. No. 5,674,656, issued Oct. 7, 1997, entitled "Processes for Stabilizing Developer Chargability and Imaging Processes Thereof", which patent discloses a process for controlling At transience comprising: providing in a developer housing, a two component developer composition comprising toner particles comprised of a resin, a pigment, a mixture of at least two charge additives, and unpreconditioned coated carrier core particles, wherein the developer is prepared by combining and thereafter blending a mixture of from 1 to about 10 parts by weight of toner particles with from about 100 parts by weight of carrier particles for about 10 minutes to about 30 minutes until an At value of from about 60 to about 100 is attained; and forming and thereafter developing electrostatographic latent images on a photoconductive member in a two component development electrostatographic imaging apparatus with the developer composition; wherein the developer composition has an At transient of less than about 20 relative units; U.S. Pat. No. 4,614,165, issued Sep. 30,1986, entitled "Extended Life Development System", wherein there is disclosed an apparatus which develops an electrostatic latent image recorded on a photoconductive member employed in an electrophotographic printing machine having a finite, usable life, which apparatus employs a developer material which ages during the life of the electrophotographic printing machine, and thus a continuous supply of carrier granules is furnished to the developer material; U.S. Pat. No. 4,948,686, issued Aug. 14,1990, entitled "Process For Forming Two Color Images", discloses a development process using a specific coated carrier with a coating weight of about 0.05 weight percent of the carrier core; U.S. Pat. No. 4,678,734, issued Jul. 7, 1987, to Laing et al., entitled "Process For Developer Composition", discloses a process for making a developer composition comprising: 1) providing carrier particles having a core with a coating thereover; 2) introducing the carrier particles into a blending apparatus; 3) adding to the blending apparatus fine toner particles with a diameter of from about 2 to about 10 microns, these particles being comprised of toner resin particles, pigment particles, and a charge enhancing additive; 4) effecting blending for a period of time sufficient to enable the classified toner particles to alter the tribogenerating ability of the surface of the carrier particles and become embedded therein; 5) subsequently adding to the resulting blended mixture toner particles of a diameter of from about 2 to about 18 microns, and which particles are comprised of toner resin, pigment particles, and a charge enhancing additive; and 6) blending for a period of from about 1 minute to about 5 minutes; U.S. Pat. No. 5,927,510, entitled "Carrier Composition And Processes Thereof", wherein there is disclosed a process comprising: blending resin coated carrier particles; separating the resulting blended carrier particles from fine particles formed while blending; and blending the blended carrier particles with toner particles to form a two component developer; and U.S. Pat. No. 5,882,834, entitled "Method of Making Developer with Stable Triboelectric Charging Properties", wherein there is disclosed a method of preparing a developer composition comprising: 1) blending carrier particles with finely divided toner particles, wherein blending is carried out for a period of time sufficient to enable the toner particles to alter the tribocharging ability of the carrier particles and become embedded therein; 2) dividing the blend of toner particles and carrier particles into coarse particles and fine particles; and 3) blending the coarse particles with toner particles.

The disclosures of each the above mentioned patents are incorporated herein by reference in their entirety. The appropriate components and processes of these patents may be selected for the toners, developers and processes of the present invention in embodiments thereof.

BACKGROUND OF THE INVENTION

The present invention is generally directed to developer compositions and processes for the preparation thereof, and more specifically, the present invention is directed to developer compositions with high conductivities, for example, from about $10^{-12}$ (ohm-cm)$^{-1}$ to about $10^{-7}$ (ohm-cm)$^{-1}$. More specifically the present invention relates to carrier and developer preparative processes, comprising, for example, blending resin coated or uncoated carrier particles in a fluidized bed jet mill and continuously separating fine particles formed therein from the resulting blended carrier particles, to provide high conductivity developers which possess highly desirable developer, development, and image properties, for example, bulk density, mass flow, conductivity, and conductivity stability with respect to developer lifetime in a xerographic development environment, excellent triboelectric charge and charge stability with respect to developer lifetime in a xerographic development environment and as a function of ambient environment, particularly temperature and relative humidity.

A problem encountered with two component electrostatic developers is the phenomena known as "charge through", which is observed when fresh or replenishing toner is added to an developer contained in a developer housing after extended operation and limited toner throughput. Although not desired to be limited by theory, it is believed that charge through causes the fresh toner to acquire a very high level of charge of the same sign as the toner in the housing prior to addition of the fresh toner. At the same time, the toner that is already present in the developer, referred to as the incumbent toner, looses much of its existing charge, and in extreme cases some or even the majority of the incumbent toner acquires a charge opposite to that of its original charge. In a xerographic developer, this will cause the incumbent toner to be developed out in background areas of a xerographic print, which undesired background area development is an unacceptable and often considered a catastrophic image quality defect. Further, it is believed that charge through may be caused by low levels of fine particle contamination contained in the developer and which contamination is believed to arise from material which is stripped or abraded from the carrier particle surface, such as metallic asperities or resin coating. The contaminants are scavenged by toner particles already present in the developer and thereby adversely alters the charging properties of both incumbent toner and fresh toner.

The above mentioned problem and related problems are overcome in embodiments of the present invention.

PRIOR ART

In U.S. Pat. No. 5,569,572, issued Oct. 29, 1996, to Laing, et al., there is disclosed a process for the preparation of developer compositions comprising providing a first developer comprised of carrier and first toner comprised of resin, pigment, polyolefin, compatibilizer, charge control agent, and surface additive, and adding thereto a second replenisher comprised of carrier, and second toner comprised of resin, pigment, polyolefin, compatibilizer, charge control agent, and surface additive, and wherein the surface additive of the second toner is present in a lesser amount than the surface additive of the first toner.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, developer compositions containing as charge enhancing additives organic sulfate and sulfonates, which additives can impart a positive charge to the toner composition. Further, there is disclosed in U.S. Pat. No. 4,298,672, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271, a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, there are illustrated toner compositions with chromium and cobalt complexes of azo dyes as negative charge enhancing additives.

The aforementioned patents are incorporated by reference herein in their entirety.

There remains a need for an economical, efficient, and environmentally acceptable method for the preparation of developers with, for example, high and stable conductivity, superior flow, environmental stability, charging properties, and imaging processes thereof.

The developer compositions and processes of the present invention are useful in many applications including imaging and printing processes, including color printing, for example, electrostatographic, such as in xerographic printers and copiers, including digital systems.

SUMMARY OF THE INVENTION

Embodiments of the present invention, include:

A process comprising: blending carrier particles in a fluidized bed jet mill and continuously separating fine particles formed therein from the resulting blended carrier particles; and A process comprising:

mixing carrier particles under high intensity shear force; and continuously separating fine particles, for example, metallic asperities and or resin coating, formed thereby from the resulting carrier particles.

These and other embodiments are illustrated herein.

BRIEF DESCRIPTION OF THE DRAWINGS

FIG. 1, in embodiments of the present invention, illustrates an exemplary fluidized bed grinder-classifier apparatus for use in accomplishing the present invention.

DETAILED DESCRIPTION OF THE INVENTION

The present invention provides, in embodiments:

A process comprising: blending carrier particles in a fluidized bed jet mill and continuously separating fine particles formed therein from the resulting blended carrier particles.

Referring to FIG. 1, there is illustrated an exemplary fluidized bed grinder-classifier apparatus for use in accomplishing the present invention. The fluidized bed jet mill can include a plurality of jetting nozzles, for example, as illustrated, wherein three jetting nozzles are juxtaposed about the outer wall of a grind chamber and are oriented so that the jet streams from the nozzles converge approximately a common point, such as along about the cylindrical axis of the grind chamber. Alternatively, one or more of the jetting nozzles can be located at the bottom of the grind chamber with the emitted jet stream being directed upward, for example, toward or along the aforementioned cylindrical axis of the grind chamber thereby permitting a focusing or convergence of the jetting nozzle particle streams.

Prior to charging the grind chamber with "virgin" carrier particles for processing, whether coated or uncoated, the jetting nozzles and the feed chamber ports are sealed off, with for example masking tape attached to a pull string or wire, to prevent loses of the carrier particles and to prevent obstruction of these openings. When the chamber is charged, sealed, and activated, the tape can be removed remotely by the pull wire.

In embodiments, and referring to FIG. 1, the present invention provides a process which can be accomplished, for example, in fluidized bed jet mill substantially as shown. The apparatus provides for the radial flow classification of solid particulate materials entrained in a fluid, for example, sonic or supersonic compressed air, comprising: a housing (1) provided with one or more nozzle assembly (10), a fine fraction outlet (12), and a coarse fraction outlet (14); and a classifier wheel (16) with a plurality of blade vanes (20) connecting the upper surface to the lower surface at the peripheral edges of the classifier wheel, and wherein the wheel (16) can optionally have a constant cut point geometry. Thus, a particle (not shown) initially entrained in the classifier wheel (16) will exit the wheel (16) either through the coarse fraction outlet (14) if above a critical or "cut point" particle size diameter or through the fine fraction outlet (12) if below a critical or cut point particle size diameter, reference for example, the aforementioned U.S. Pat. No. 5,927,510, the disclosure of which is incorporated herein by reference in its entirety. Other components including nozzles (2), high pressure compressed air line (3), nozzle opening (4), and classifier assembly (8) are known in the art, reference for example, U.S. Pat. No. 5,683,039, the disclosure of which is incorporated herein by reference in its entirety.

Is will also be readily evident to one of ordinary skill in the art of fluid bed grinding that the classifier assembly (8) can be oriented vertically (as shown) or horizontally including the classifier wheel (16) and connected drive shaft 18) without substantial differences in performance. The apparatus can also include an optional particle recirculation system for recirculating and entraining particles within the continuous jet streams including intake port (6) and conduit (5) which components permit particles to be directed to nozzle opening (4) for entrainment with the high pressure compressed air jet stream. The present apparatus can also include an optional feed inlet chute (not shown) which permits convenient batch loading or continuous feeding of unground or fresh particles to the apparatus, reference the aforementioned U.S. Pat. No. 5,927,510.

The fluidized bed jet mill provides high intensity blending of the carrier particles with a velocity of from about 150 meters per second to about 230 meters per second. The separation of the fine particles from the blended carrier particles can be accomplished with an integral separation device, for example, a classifier situated within the fluidized bed jet mill. Blending of the carrier particles can be accomplished, for example, in from about 5 minutes to about 4 hours.

The fine particles can be particulates, for example, of from about 0.1 microns to about 5.0 microns in volume mean diameter, and which particulates can arise from the metallic asperities on the surface of the carrier particles. The resulting blended carrier can have a conductivity value, for example, of from about $10^{-12}$ (ohm-cm)$^{-1}$ to about $10^{-7}$ (ohm-cm)$^{-1}$. Although not wanting to be limited by theory, it is believed that the removal of fine particles from the carrier particulates results appreciable rounding of the carrier particulates and smoothing of the particulate's surface, for example, by removal of either or both the aforementioned metallic asperities, and in the case of polymer coated particulates, removal of polymeric coating irregularities or imperfections. Thus the present invention can further comprise the removal of fine particles which arise from the resin coating being removed from the surface of coated carrier particles.

The processes of the present invention in embodiments can further comprise blending the resulting blended carrier particles with toner particles to form a two component developer.

The carrier particles of the present invention can be resin coated or uncoated, and preferably resin coated. In embodiments, the resin coating can comprises from about 0.025 to about 5 weight percent of a single thermoplastic polymer. In other embodiments, the carrier coating can comprises two or more thermoplastic polymers, for example, from about 0.025 to about 5 weight percent of the carrier particles of a mixture of polymethylmethacrylate and polyester-urethane in a weight ratio of from about 20:80 to about 80:20. The carrier coating can be a polymer such as polyesters, polyester-urethanes, polyurethanes, cross-linked polyurethanes, polymethylmethacrylates, fluorinated polymers, polystyrenes, styrene-acrylate copolymers, and mixtures thereof.

A preferred carrier coating is a polyester-urethane polymer, for example, ENVIROCON® polymers available from PPG Industries, Inc., from about 0.01 to about 3.0 weight percent. In embodiments, the carrier coating can further comprise conductive and non conductive additives such as colored and colorless pigments, fillers, dye compounds, and mixtures thereof.

The present invention provides, in embodiments, a process comprising:

mixing carrier particles under high intensity shear force with a velocity, for example, of from 150 meters per second to about 230 meters per second; and continuously separating fine particles formed thereby from the resulting carrier particles. The resulting carrier particles provide a highly robust developer material which minimizes or eliminates toner charge through phenomena when the carrier particles are subsequently blended with toner particles to form a developer.

Two-component xerographic developers can be made either insulating or conducting depending upon whether the carrier particles are conductive, reference for example, the Xerox Corporation Model 1090® series which employs partially coated carriers having conductivities of about $10^{-10}$ (ohm-cm)$^{-1}$ and completely coated carriers of the Xerox Corporation Model 5090® series with conductivities of less than about $10^{-14}$ (ohm-cm)$^{-1}$. Developer conductivity increases the rate of solid-area development (SAD) and thus is a means of improving "fill" of extended areas in magnetic brush development. In hybrid scavengeless development (HSD) and hybrid jumping development (HJD), a magnetic brush deposits toner on a donor roller, and this donor subsequently develops the image, reference for example the Xerox Corporation DOCUCENTRE® 265 development system. Developer conductivity is advantageous in these systems primarily because it increases the rate of toner deposit on the donor roller. In order to produce uniform extended images with HSD or HJD it is preferable that the donor be loaded to a near-equilibrium value in one rotation against the magnetic brush, otherwise an extended-image area will be developed more heavily at the edge where the donor loading is at an equilibrium value than at an internal area where the donor was stripped in developing the upstream edge of the image and then not fully reloaded. This could result in an image density gradient on a line corresponding to the last area developed by a fully-loaded donor and the beginning of the area developed by a partially-loaded donor. This line or area of development discontinuity constitutes an image defect called a "reload defect". Reload defects are measured in terms of optical density differences across this line of demarcation. Alternatively, a laboratory method of defining a reload defect is to measure the electrical potential above the donor due to the charge of the toner layer. When the potential of the donor, after one pass across the magnetic brush, is equal to the potential after many passes, there will be no reload defect. This condition defines ideal or 100 percent reload. If the potential after one pass is, for example, about 50 percent of the equilibrium potential, the reload would be about 50 percent. The ultimate measure of reload is obtained from actual images and not extrapolation from electrostatic measurements. While a complete understanding of the relationship between optical density measurements of reload and electrostatic measurements of reload is not available, since the relationship depends upon a large number of factors, correlation is still apparent. For example, it has been observed that developers producing reload of about 50% or greater as measured by the electrostatic method generally produce little or no observable reload defect, while developers with reload of about 40% or less generally produce observable defects. The reason that donor potential reload measurements of only about 50% may result in no visible reload defects is believed to be related to differences in the charge-to-mass ratio of toner deposited on the donor after the first development pass compared to the charge-to-mass ratio of toner after many passes. As the donor is re-developed in each pass by the magnetic brush, low-charge toner is scavenged and replaced by higher charge-to-mass toner. Thus, first-pass toner may produce a dense image even though its charge-to-mass is lower than multi-pass toner.

The present invention provides developers wherein the reload defect is not present even on the first copies produced from a fresh developer. Without employing the present invention to developer compositions, many otherwise excellent developer compositions may have a serious reload defect on first use of a fresh developer that persists for many thousands of copies and is therefore unsuitable for general use.

The blending or conditioning of the uncoated carrier particles only, that is, blending a measured amount of uncoated carrier, can be accomplished, for example, in about 5 minutes to about 4 hours thereby increasing the carrier bulk conductivity, for example, from less than about $10^{-14}$ (ohm-cm)$^{-1}$ to about $10^{-13}$ (ohm-cm)$^{-1}$ and above. In another embodiment, blending the coated carrier particles for a period of time sufficient, for example, from about 5 minutes to about 4 hours, to achieve a conditioned carrier with a conductivity value of from about $10^{-12}$ (ohm-cm)$^{-1}$ to about $10^{-7}$ (ohm-cm)$^{-1}$. Although not wanting to be limited by theory it is believed that the conditioning process of the present invention can remove resin coating from the asperities or on the carrier surface thereby allowing greater conductive contact between carrier particles.

The separation of the resulting blended carrier particles from fine particles, such as the aforementioned asperities and polymer particles that have been dislodged from the coated carrier surface can be accomplished with a particle classifier integral with and operating simultaneously and within the fluidized bed jet mill to separate the generated fine particles from desired coarse particulate material. The fine particles can comprise, for example, particulates with nominal diameters from about 0.1 microns to about 5.0 microns and can arise from the metallic asperities and or resin coating being mechanically removed from the surface to the carrier particles.

The resulting developer formed from blending the conditioned carrier with toner particles possesses improved reload efficiency at time zero as determined by improved and substantially constant printed image density or from donor potential reload measurements, for example, of over 50% compared to reload measurements of less than 50% for a developer prepared without blending and separating the blended coated carrier particles, that is, unconditioned carrier. A high intensity fluidized bed jet mill grinder process of the present invention also affords advantages of reduced processing times and very high product uniformity and reliability.

The present invention provides, in embodiments, an imaging process comprising employing a carrier or developer obtained in accordance with the aforementioned conditioning processes in a known conductive magnetic brush development system, for example, as found in a Xerox Corporation Model 1075®, wherein a high development rate is enabled by the enhanced carrier conductivity and which conductivity is believed to be attributable to the preconditioning process. The imaging process provides excellent image fill from a first imaging use or time zero (t=0) use. The imaging process provides improved image fill, for example, from poor using an unconditioned carrier where print quality defects such as deletions are observed, to excellent using conditioned carriers or developers of the present invention where substantially no deletions are observed at time zero.

The carrier coating can be any suitable known polymer such as polyesters, polyester-urethanes, polyurethanes, cross-linked polyurethanes, polyalkylmethacrylates, fluorinated polymers, polystyrenes, styrene-acrylate copolymers, mixtures thereof, and the like materials, including polymethylmethacrylates, polyvinylidene fluorides, and the like materials. In embodiments, the carrier coating selected is a polyester-urethane polymer, for example, ENVIRO-CON® polymers available from PPG Industries, Inc., such as in amounts of about 0.1 to about 1.0 weight percent, and more preferably in amounts of about 0.4 to about 0.5 weight percent based on the weight of the carrier particles. The carrier coating can further comprise additional known performance additives, such as conductive and non conductive additives, including but not limited to colored and colorless pigments, organic and inorganic fillers, dyes, such as dye compounds, and mixtures thereof, and more specifically, such as carbon black, magnetites, copper iodides, fillers including glass, minerals, and the like materials. The carrier coating can comprise from about 0.01 to about 10, and preferably from about 0.025 to about 3 weight percent of the carrier particles of a mixture of polymers or copolymers, such as a polymethylmethacrylate and polyester-urethane in a weight ratio of from about 20:80 to about 80:20. Alternatively, a single polymer can be used in the polymer coating in amounts of about 0.025 to about 3 weight percent, for example a polyester-urethane, to provide an insulting carrier which could be rendered conductive when employed in the processes of the present invention.

The tribocharging ability of the coated carrier particle is for example from about 20 to about 80 microcoulombs per gram before blending with a first toner, preferably from about 20 to about 60, and is more preferably from about 20 to about 50 microcoulombs per gram after blending with toner. Similarly, the carrier tribo after blending with a second toner is in a comparable range. The process of the present invention does not appear to adversely effect the tribocharging ability of the carrier or toners used in developing images in that the resulting preconditioned carrier and resulting developers have tribo-values well within acceptable performance ranges.

Suitable resins for the toner for use with the carrier particles of the present invention include, for example, styrene-butadienes, styrene acrylates, styrene methacrylates, polyesters, and the like polymers, and mixtures thereof and other known resins. The toner can be selected in amounts, for example, from about 0.1 to about 10 weight percent based on the weight of the carrier particles.

The toners can further include charge additives materials or compounds present in an amount of from about 0.05 to about 5 weight percent based on the weight of the toner, and wherein toners can have an admix time of from about 1 to about 14 seconds and a triboelectric charge of from about 10 to about 40 microcoulombs per gram. The resulting developer materials can have a conductivity of from about $10^{-12}$ (ohm-cm)$^{-1}$ to about $10^{-7}$ (ohm-cm)$^{-1}$.

Toner compositions can be prepared by a number of known methods, such as admixing and heating resin particles such as styrene butadiene copolymers, colorant particles such as magnetite, carbon black, or mixtures thereof, and cyan, yellow, magenta, green, red, blue, red, orange, violet or brown or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 98 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Colorant includes pigments, dyes, mixtures thereof, mixtures of pigments, mixtures of dyes, and the like. Numerous well known suitable colorants, such as pigments or dyes, can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling magnetic ink character recognition (MICR) toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the toners used in conjunction with the present invention, colloidal silicas, such as AEROSIL®, can be surface treated with the charge additives in an amount of from about 1 to about 30 weight percent and preferably from about 1 to about 10 weight percent followed by the addition of the resulting treated colloidal particles to the toner in an amount of from 0.1 to 10 and preferably from about 0.1 to about 5 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toners and developer compositions comprised of toner resin particles, carrier particles, charge enhancing additives, and as pigments or colorants such as magnetite, carbon black, or mixtures thereof, and cyan, yellow, magenta, blue, green, red, orange, violet or brown, and the like colorants, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles. Particularly preferred pigments for use in the present invention are disclosed in, for example, U.S. Pat. No. 5,556,727, the disclosure of which is incorporate in it entirety herein by reference, such as Pigment Blue 15:3 C.I. 74160, Pigment Red 81:3 C.I. 45160:3, and Pigment Yellow 17 C.I. 21105.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference particles used the aforementioned coating composition, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected. As illustrated in the Examples herein, the toner particles can be negatively chargeable and the carrier particles are positively chargeable.

Furthermore, the diameter of the carrier particles, is generally from about 35 microns to about 1,000 microns, and in embodiments from 50 to about 175 microns thereby permitting them to possess sufficient density and inertia to avoid adherence to the electrostatic images during the development process. The carrier component can be mixed with the toner composition in various suitable combinations Excellent results are obtained when about 1 to about 5 parts toner to about 10 parts to about 200 parts by eight of carrier are selected.

The toner composition used in conjunction with the coated or uncoated carriers of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 3 to about 25 microns, more preferably from about 4 to about 12 microns, and most preferably from about 5 to about 8 microns. Also, the toner compositions preferably possess a tribo charge to diameter ratio of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions, in embodiments, of the present invention possess desirable narrow negative charge distributions, optimal charging triboelectric values, preferably of from about −10 to about −60, and more preferably from about −10 to about −40 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Coated Carriers

Coated carriers were prepared by coating a suitable polymer or mixture of polymers, for example, by solution or powder coating methods, onto metal core particles then heat fused in an oven or a kiln, reference for example commonly owned and assigned U.S. Pat. No. 4,937,166, to Creatura et al., which discloses polymer coated carrier particles for electrophotographic developers, the disclosure of which is incorporated by reference herein in its entirety. In an illustrative example, ENVIROCRON® a polyester-urethane powder, commercially available from P.P.G. Industries, Inc., was admixed with 65 micron diameter steel core particles, for example, as commercially available from Hoeganaes Inc., in a Munson blender at about one (1) weight percent coating with respect to the weight of the carrier core particles. The mixture was admixed for about 30 minutes until the cores were uniformly coated with polymers. The polymer coated core particles were then passed through a rotary kiln operating at about 390° F. The polymer coating thereby fused to core particles.

The resulting fuse-coated carrier particles were either evaluated directly (unconditioned) or conditioned in accordance with the present invention as set forth below in either a blender or a fluidized-bed jet mill as specified prior to preparing a developer. An example of conditioning of carriers in accordance with the present invention is set forth in the Example

EXAMPLE II

Jet Mill Conditioning and Evaluation of Coated Carrier Particles of Example I

The coated carrier core particles of Example I were blended or conditioned under high shear and with continuous removal of in situ generated fines in a fluidized-bed jet grinder as illustrated herein. About 10 pounds of a one (1) weight percent or about 3.5 pounds of ENVIROCRON® polyester-urethane powder coated 65 micrometer nominal diameter Hoeganaes core was placed in a fluidized-bed jet grinder and thereafter fluidized. A suitable fluidized-bed jet mill is the commercially available ALPINE 100 AFG apparatus, or a fluidized-bed jet grinder as modified and shown in FIG. 1. The material is ground for about 30 minutes at a grind pressure of about 60 pound per square inch (psig) which provided a jetting velocity of from about 150 meters per second to about 230 meters per second, and a classifier wheel speed of about 1,320 revolutions per minute. The resulting fine particles were continuously separated from the more dense carrier core particles by the classifier situated above the core particles within the classifier. The procedure could be replicated on larger scales, for example, using from about 20 to about 100 pounds of the coated or uncoated carrier particle in the initial charge to the grinder chamber, for a period of from about 2 to about 5 hours at comparable operating conditions. Illustrative results are summarized and compared in Table 1 below.

EXAMPLE III

Evaluation of Uncoated Carriers Conditioned in a Jet Mill

Example II was repeated with the exception that an uncoated carrier was substituted for the coated carrier particles of Example II. The carrier particles were otherwise processed substantially identically with the result that a high conductivity uncoated carrier was produced. Mass flow and bulk density for this material are also higher than for all other carriers treated by the same process. The results are summarized and compared in Table 1 below.

COMPARATIVE EXAMPLE I

Evaluation of Unconditioned Coated Carriers

The coated carrier of Example I was evaluated directly and without conditioning contrary to Example II, with the result that the conditioned carrier is more conductive and also has a higher mass flow and bulk density than the unconditioned carrier. For example, on average, a four decade increase in conductivity was observed. The results are summarized and compared in Table 1 below.

COMPARATIVE EXAMPLE II

Evaluation of Coated Carriers Conditioned Using a Blender

Example II was repeated with the exception that a coated carrier was conditioned in a Littleford blender with the result that conductivity, mass flow, and bulk density increased. If the carrier conditioned in a blender is evaluated against the carrier conditioned in the fluid bed jet mill, it is noticed that the carrier conditioned in the jet mill is still more conductive than the carrier conditioned in the blender. This result is believed to arise from a more intensive agitation inside the jet mill due to the fluidization of the material by the air stream going through the nozzles. The results are summarized and compared in Table 1 below.

COMPARATIVE EXAMPLE III

Evaluation of Uncoated and Unconditioned Carriers

Uncoated carrier particles were evaluated directly and without conditioning contrary to Examples I and II, with the result that the uncoated carrier without conditioning was less conductive and has a lower mass flow and bulk density than the uncoated carrier that has been conditioned. The results are summarized and compared in Table 1 below.

COMPARATIVE EXAMPLE IV

Evaluation of Mixed Resin Coated and Unconditioned Carriers

Mixed resin coated carrier particles as described in Comparative Example V below were evaluated directly and without conditioning, with the result that the unconditioned carrier has the lowest conductivity of all carriers evaluated. The mixed resin coated carrier also has the third lowest mass flow and bulk density of all carriers evaluated. The results are summarized and compared in Table 1 below.

COMPARATIVE EXAMPLE V

Valuation of Mixed Resin Coated and Blender Conditioned Carriers

Coated carriers were prepared by coating a suitable polymer or mixture of polymers, for example, by solution or powder coating methods, onto metal core particles then heat fused in an oven or a kiln, reference for example commonly owned and assigned U.S. Pat. No. 4,937,166, to Creatura et al., the disclosure of which are incorporated in its entirety herein by reference, which discloses polymer coated carrier particles for electrophotographic developers. In an illustrative example, ENVIROCRON® a polyester urethane powder, commercially available from P.P.G. Industries, Inc., was premixed in an 80:20 weight ratio in a blender with a polymethylmethacrylate polymer containing about 20 weight percent carbon black made by a semisuspension polymerization process with a volume median particle size of between 2 and 3 microns, reference for example commonly owned and assigned U.S. Pat. No. 5,236,629, the disclosure of which are incorporated in its entirety herein by reference. The resulting premixture of polymers was then admixed with 65 micron diameter steel core particles, for example, as commercially available from Hoeganaes Inc., in a Munson blender at one (1) weight percent coating with respect to the weight of the core particles. The materials were admixed for about 30 minutes until the cores were uniformly coated with polymers. The polymer coated core particles were then passed through a rotary kiln operating at about 390° F. The polymer coating thereby fused to core particles. The resulting fuse-coated carrier particles were conditioned in the absence of toner and thereafter conditioned to prepare developer. Conditioning of carrier and developers was accomplished by, for example, as set forth in the Example II with the exception that a Littleford blender was used with the result that the carrier conditioned in the blender is more conductive and has higher mass flow than the unconditioned carriers. For example, a two decade increase in conductivity was observed. No major changes in bulk density were observed. The results are summarized and compared in Table 1 below.

EXAMPLE IV

Evaluation of Mixed Resin Coated Carriers Conditioned in a Jet Mill

Mixed resin coated carrier particles as described in Comparative Example V were evaluated after conditioning in a jet mill, with the result that the carrier conditioned for 20 minutes is more conductive and has a higher mass flow and bulk density than the unconditioned carrier, as presented in Comparative Example IV. The conditioned carrier also has a higher conductivity, mass flow, and bulk density than the carrier conditioned in the blender, as presented in Comparative Example V. This is believed to be the result of a more intensive agitation inside the jet mill due to the fluidization of the material by the air stream going through the nozzles. The results are summarized and compared in Table 1 below.

EXAMPLE V

Evaluation of Mixed Resin Coated Carriers Conditioned in a Jet M

Mixed resin coated carrier particles as described in Comparative Example V were evaluated after conditioning in a jet mill, with the result that the carrier conditioned for 43 minutes is more conductive and has a higher mass flow and bulk density than the unconditioned carrier as presented in Comparative Example IV. The carrier also has a higher conductivity, mass flow, and bulk density than the carrier conditioned in the blender, as presented in Comparative Example V, and also the carrier conditioned in the jet mill for 20 minutes as presented in Example IV. The results are summarized and compared in Table 1 below.

EXAMPLE VI

Xerographic Evaluation of Mixed Resin Coated Carriers Conditioned in a Jet Mill

Resin Preparation

A toner resin was prepared by a polycondensation reaction of propoxylated bisphenol A and fumaric acid to form a linear polyester referred to as Resapol HT. A second polyester was prepared by selecting Resapol HT and adding to it in an extruder a sufficient amount of benzoyl peroxide to form a crosslinked polyester with a high gel concentration of about 30 weight percent gel, reference U.S. Pat. Nos. 5,376,494; 5,395,723; 5,401,602; 5,352,556, and 5,227,460, and more specifically, the polyester of the '494 patent, the disclosures of each of these patents being totally incorporated herein by reference.

Toner Preparation

In the second step, 55.34 parts by weight of the resin Resapol HT above, 17.99 parts by weight of the 30 weight percent gelled polyester from above, and, 26.67 parts by weight of Sun Resin Bond Flush Yellow, which is a mixture of 30 weight percent P.Y.17 (C.I. 21105) and 70 weight percent Resapol HT prepared at Sun Chemical by flushing to obtain a high quality pigment dispersion, were blended together and extruded in a ZSK-40 extruder. The extruded blend was then jetted and classified to form a yellow toner (with 92 weight percent of resin and 8 weight percent of P.Y. 17) with a toner particle size of about 7.3 microns as measured by a Layson Cell. The final yellow toner had a gel concentration of about 5 weight percent. A toner blend was prepared by mixing the yellow toner with 2.6 weight percent NA50HS silica obtained from DeGussa/Nippon Aerosil Corp, 2.0 weight percent SMT5103 crystalline titanium dioxide core MT500B surface treated with decyl silane, obtained from Tayca Corp., and 0.3 weight percent zinc stearate L from Ferro Corporation. The mixing was accomplished using a 75 Liter Henschel vertical blender at 1380 rpm for a blend time of 4 minutes.

Developer Preparation and Evaluation

A developer was prepared by mixing 4.5 parts of the above blended yellow toner with 100 parts of the carrier prepared in Example IV. The performance of this developer was characterized in a xerographic development subsystem test fixture consisting of a Hybrid Scavengeless Development (HSD) Housing and associated toner dispenser mounted with appropriate motors and power supplies. An anodized aluminum receiver roll with a cleaning blade is mounted as a receiver to simulate the photoreceptor electrical and speed characteristics. It is computer controlled to simulate cycle-up and cycle-down timing as well as to cycle the electrostatics in variable periodic electrical pulses, which switch from cleaning to development field and can be programmed to simulate differing area coverage and thus toner throughput. Toner is thus developed in variable width bands across the receiver roll. A toner concentration (TC) sensor is used to control toner dispense. This fixture was run in an A-Zone controlled Environment, (80 degrees F, 80% Relative Humidity). The test procedure involves running the fixture for 80 minutes, or an equivalent of 5,760 prints, at a throughput rate of 2 grams per minute, followed by a zero throughput (0 g/min) segment of 20 minutes, and then 20 minutes at a high throughput rate of 4 g/min, or an equivalent of 1,440 prints at each. During the test, the Toner Concentration ranged from 4.2 to 5.6%. Following a break-in period during the first 2 minutes of running, tribo averaged −31.1 $\mu$C/g between 5 and 60 minutes at 2 g/min. This meets or exceeds the required level of about −30 $\mu$C/g necessary to prevent objectionable image quality shortfalls. After 60 minutes, the charge distribution is very narrow with a mean charge to diameter ratio of −0.30 fC/micron. At this same point in the test developability is found to be strong, with a DMA of 0.90 mg/cm$^2$ at a $V_{dev}$ of 200 Volts. Toner charge to mass ratio remained stable during the other area coverage portions of the test, with tribo of −37.0 and −34.5 $\mu$C/g at the end of 0 g/min and 4 g/min, respectively. The charge distribution after 20 minutes of 4 g/min running is also narrow, with a mean charge to diameter ratio of −0.33 fC/micron.

The above test was not carried out using developers made with carrier of Comparative Example IV or Comparative Example V, that is, carriers which were not processed further after the resin coating step, or carriers which were conditioned in a device other than a fluidized jet mill. Based on the carrier conductivity values shown in Table I, it is known that these carriers would exhibit severe and highly objectionable image quality shortfalls, specifically low developability, such as, less than about 0.4 mg/cm$^2$, for example, as well as "reload defects", which are optical density differences related to highly variable developability which is strongly dependent on the previously developed image on the photoreceptor or receiver roll. These image quality shortfalls are not observed with the carrier conditioned in accordance with the present invention.

EXAMPLE VII

Xerographic Evaluation of Mixed Resin Coated Carriers Conditioned in a Jet Mill

A developer was prepared by mixing 4.5 parts of the blended toner from Example VI with 100 parts of a carrier prepared in Example V. The performance of this developer was characterized by the same methods used in Example VI. Using the xerographic development subsystem test fixture in A-Zone Environment, toner concentration ranged from 4.3 to 6.5%. Toner charge rises from approximately −25 to about −45 $\mu$C/g over the first 60 minutes of running. to Following a break-in period during the first 2 minutes of running, tribo averaged −32.4 μC/g between 5 and 60 minutes at 2 g/min. This meets or exceeds the required level of about −30 RC/g necessary to prevent objectionable image quality shortfalls. After 60 minutes, the charge distribution is very narrow with a mean charge to diameter ratio of −0.33 fC/μm. At this same point in the test developability is found to be strong, with a DMA of 0.83 mg/cm$^2$ at a $V_{dev}$ of 200 Volts. Toner charge to mass ratio remained stable during the other area coverage portions of the test, with tribo of about −41.3 and −37.1 μC/g at the end of 0 g/min and 4 g/min, respectively. The charge distribution after 20 minutes of 4 g/min running is also narrow, with a mean charge to diameter ratio of about −0.42 fC/μm.

Other modifications of the present invention may occur to one of ordinary skill in the art based upon a review of the present application and these modifications, including equivalents thereof, are intended to be included within the scope of the present invention.

TABLE 1

Comparative Data for Carrier Preparative Treatments.

| Example | Coating | Mass flow (g/sec)[1] | Bulk Density (g/cm$^3$)[2] | Conductivity (micro-ohms/cm) |
|---|---|---|---|---|
| II | ENV[3] | 2.19 | 3.30 | $8.92 \times 10^{-11}$<br>$2.05 \times 10^{-9}$ |
| III | none | 2.77 | 3.17 | $2.6 \times 10^{-6}$ |
| Comparative I | ENV[3] | 1.46 | 2.52 | $4.22 \times 10^{-13}$<br>$2.86 \times 10^{-15}$ |
| Comparative II | ENV[3] | 1.67 | 2.73 | $4.05 \times 10^{-13}$ |
| Comparative III | none | 2.03 | 2.89 | $1.48 \times 10^{-8}$ |
| Comparative IV | 4:1 ENV:PMMA[4] | 1.68 | 2.80 | $4.73 \times 10^{-15}$<br>$3.85 \times 10^{-15}$ |
| Comparative V | 4:1 ENV:PMMA[4] | 1.73 | 2.81 | $2.73 \times 10^{-13}$ |
| IV | 4:1 ENV:PMMA[4] | 1.95 | 3.14 | $1.69 \times 10^{-9}$ |
| V | 4:1 ENV:PMMA[4] | 2.10 | 3.28 | $9.27 \times 10^{-8}$ |

[1] est. error =+/− $2.63 \times 10^{-3}$
[2] est. error =+/− $5.02 \times 10^{-3}$
[3] ENVIROCRON ™ at an initial coating weight of about 1 percent.
[4] 80% ENVIROCRON ™ and 20% polymethylmethacrylate polymer at an initial coating weight of about 1 percent.

What is claimed is:

1. A process comprising:

blending carrier particles in a fluidized bed jet mill with a velocity of from about 150 meters per second to about 230 meters per second; and continuously separating with a classifier situated within the fluidized bed jet mill the fine particles formed therein from the resulting blended carrier particles.

2. A process in accordance with claim 1, wherein blending of the carrier particles is accomplished in about 5 minutes to about 4 hours.

3. A process in accordance with claim 1, wherein the fine particles comprise particulates of from about 0.1 microns to about 5.0 microns and which particulates arise from the metallic asperities on the carrier particles.

4. A process in accordance with claim 1, wherein the resulting blended carrier has a conductivity value of from about $10^{-12}$ (ohm-cm)$^{-1}$ to about $10^{-7}$ (ohm-cm)$^{-1}$.

5. A process in accordance with claim 1, further comprising blending the resulting blended carrier particles with toner particles to form a two component developer.

6. A process in accordance with claim 1, wherein the carrier particles are resin coated.

7. A process in accordance with claim 6, further comprising wherein the fine particles arise from resin coating being partially removed from the surface of the coated carrier particles.

8. A process in accordance with claim 6, wherein the resin coating comprises from about 0.025 to about 3 weight percent of a single thermoplastic polymer.

9. A process in accordance with claim 6, wherein the carrier coating comprises from about 0.025 to about 3 weight percent of the carrier particles of a mixture of polymethylmethacrylate and polyester-urethane in a weight ratio of from about 20:80 to about 80:20.

10. A process in accordance with claim 6, wherein the carrier coating is a polymer selected from the group consisting of polyesters, polyester-urethanes, polyurethanes, cross-linked polyurethanes, polymethylmethacrylates, fluorinated polymers, polystyrenes, styrene-acrylate copolymers, and mixtures thereof.

11. A process in accordance with claim 6, wherein the carrier coating is a polyester-urethane polymer.

12. A process in accordance with claim 6, wherein the carrier coating further comprises conductive and non conductive additives selected from the group consisting of colored and colorless pigments, fillers, dye compounds, and mixtures thereof.

13. A process in accordance with claim 6, wherein the carrier coating comprises from about 0.025 to about 3 weight percent of the carrier particles of a mixture of polymethylmethacrylate and polyester-urethane in a weight ratio of from about 20:80 to about 80:20.

14. A process comprising:

mixing carrier particles under high intensity shear force with a velocity of from 150 meters per second to about 230 meters per second; and continuously separating fine particles formed thereby from the resulting carrier particles, wherein the mixing is accomplished in a fluidized bed jet mill and wherein separation of fine particles is accomplished with a classifier situated within fluidized bed jet mill.

15. A process in accordance with claim 14, further comprising blending the resulting carrier with toner particles to form a developer.

16. A process in accordance with claim 14, wherein the resulting carrier particles possess a conductivity value of from about $10^{-12}$ (ohm-cm)$^{-1}$ to about $10^{-7}$ (ohm-cm)$^{-1}$.

17. A process in accordance with claim 14, wherein the amount of separated fine particles comprise from about 0.1 to about 2 weight percent of the total weight of the carrier particles.

18. A process in accordance with claim 14, wherein the separated fine particles comprise material removed from the surface of the carrier particles and consists of metallic asperities, resin coating, or mixtures thereof.

* * * * *